US009770091B2

(12) United States Patent
Spinosa

(10) Patent No.: US 9,770,091 B2
(45) Date of Patent: Sep. 26, 2017

(54) ORTHO-BUDDY, AN ORTHODONTIC TOOTHBRUSH

(71) Applicant: Thomas Spinosa, Claremont, CA (US)

(72) Inventor: Thomas Spinosa, Claremont, CA (US)

( * ) Notice: Subject to any disclaimer, the term of this patent is extended or adjusted under 35 U.S.C. 154(b) by 0 days.

(21) Appl. No.: 14/999,276

(22) Filed: Apr. 18, 2016

(65) Prior Publication Data

US 2017/0027313 A1 Feb. 2, 2017

Related U.S. Application Data

(60) Provisional application No. 62/282,152, filed on Jul. 28, 2015.

(51) Int. Cl.

| | |
|---|---|
| ***A46B 3/18*** | (2006.01) |
| ***A46B 9/04*** | (2006.01) |
| ***A46B 9/02*** | (2006.01) |

(52) U.S. Cl.

CPC ..... *A46B 9/04* (2013.01); *A46B 3/18* (2013.01); *A46B 9/026* (2013.01); *A46B 2200/1066* (2013.01)

(58) Field of Classification Search

CPC ..... A46B 3/18; A46B 9/04

USPC ..... 15/206–207

See application file for complete search history.

(56) References Cited

U.S. PATENT DOCUMENTS

| | | | | |
|---|---|---|---|---|
| 4,751,761 A * | 6/1988 | Breitschmid | A46B 3/18 | 15/167.1 |
| 5,537,708 A * | 7/1996 | Luposello | A46B 9/04 | 15/160 |
| 5,613,258 A * | 3/1997 | Hilfinger | A46B 3/18 | 15/206 |
| 7,698,772 B1 * | 4/2010 | Hauser, Jr. | A46B 3/18 | 15/167.1 |

* cited by examiner

*Primary Examiner* — Laura C Guidotti

(57) ABSTRACT

An orthodontic toothbrush whose nylon bristles are configured in a radial pattern around a base wire or plastic cylinder, and is long enough to attain a cylindrical shape. That brush shape is then attached to a handle. The new pattern of bristles makes thorough cleaning above and below the brackets efficient and easy for all patients. The area between the brackets and the gum line, another area ordinarily missed during routine brushing is also now easily cleansed. The areas between the brackets are also easily cleansed since the radial design allows bristles to penetrate in all directions. Decalcification and decay both major problems during orthodontic treatment due to improper brushing technique can now be addressed.

2 Claims, 1 Drawing Sheet

ORTHO-BUDDY, AN ORTHODONTIC TOOTHBRUSH

BACKGROUND OF THE INVENTION

This invention addresses toothbrushing by a patient who is wearing orthodontic appliances on their teeth, that is braces.

One of the main problems faced by the patient and the orthodontist is proper cleaning of the teeth during orthodontic treatment. If plaque, which is a colony of bacteria, is not completely removed each day the patient runs the risk of demineralization of the enamel which initially appears as permanent white scars on the surface of the tooth. These white spots or scars are weakened areas in the surface enamel which eventually lead to cavitation or fracture of the surface, also known as decay. Wearing braces makes thorough cleaning and removal of all plaque very difficult for all patients. Young patients especially lack the manual dexterity needed to correctly position the bristles of an ordinary toothbrush. Also, ordinary toothbrushes are very bulky and make it very difficult to position the toothbrush so that the bristles can access all of the areas around, under and in between the brackets. Therefore some areas are constantly or commonly neglected. These areas include underneath the wings of the orthodontic brackets, the areas between adjacent brackets and the areas below the brackets and adjacent to the gum tissue or gingiva.

Some orthodontic toothbrushes have attempted to address these problems however lack specifically important features.

Stofko, U.S. Pat. No. 9,095,205 has bristles orientated in 2 different directions. However most of the bristles are orientated perpendicularly to the tooth surface. This type of orientation never allows proper penetration down to the gingival margin, which is where the tooth meets the gum tissue. This is one of the areas with the highest incidence of decalcification. This toothbrush is also configured like all other toothbrushes in that it has a very bulky plastic portion that contains the bristles and therefore cannot fit into the oral vestibule, the area between the tooth and lips. This makes brushing below brackets on the bottom and above the brackets on the top very very difficult.

De Ricco's U.S. Pat. No. 9,084,471 is a toothbrush that requires several different manipulations to brush effectively. For each and every quadrant, the brush must be reorientated and therefore held differently. This kind of manipulation is very confusing for all patients but especially young patients which make up the majority of the orthodontic population.

This is why the ortho-buddy was invented. First, it is easy to use and therefore requires very little explanation to the patient. Second, it's compact design allows it to be placed easily above and below the brackets, the area where all ordinary toothbrushes do not fit. Lastly its 360 radial bristle design allows thorough penetration of the bristles to the most commonly neglected areas during orthodontic tooth brushing. The patient's teeth with proper brushing can now remain healthy during the orthodontic treatment process which can last on average 2 years but sometimes can extend far beyond that. The orthodontist can now concentrate on managing the care of the patient and not worry about any harm being done to the teeth due to poor hygiene.

BRIEF SUMMARY OF THE INVENTION

It would be desirable to have an orthodontic toothbrush that would simultaneously clean between the teeth and brackets on adjacent teeth, underneath the bracket wings and also the entire area between the bracket and up to the gingival margin, that is the gum line. These are the three areas most often missed during regular toothbrushing by many orthodontic patients. It would also be very desirable if the brush required no special angling or manipulation by the patients, was easy to use for all age groups and required little or no explanation or training. One solution is to have a toothbrush as described here, which is made in a cylindrical shape where all the bristles radiate out in a 360 degree pattern from a central point. Because of this shape, when placed over or under the brackets, bristles point in all directions simultaneously, therefore no special manipulation of the toothbrush handle is necessary. Because the brush does not have a bulky plastic portion like most toothbrushes it easily and comfortably fits up into the oral vestibule, the area between the teeth and the lips. This is the area that the bristles need to be in order to brush under and around the orthodontic brackets and near the gum line.

Patients have a very difficult time positioning an ordinary toothbrush up into this area because ordinary brushes have a bulky plastic portion and cannot fit here properly. Therefore effective brushing with a normal toothbrush is extremely difficult for most patients. Ortho-buddy eliminates this problem and therefore the patient and doctor will not have to worry about decalcification and decay during treatment.

Orthodontic treatment typically lasts for approximately 2 years. Poor or inadequate brushing can cause white spots or decalcification marks on teeth in a few months. Decay can follow decalcification. Patients that cannot master good hygiene can have their treatment discontinued or suffer the end results of poor hygiene. Poor hygiene also leads to gingivitis or gum infection. Over a prolonged period of time this can cause a permanent enlargement or hypertrophy of the gum tissue that can require post orthodontic gum surgery. Good hygiene eliminates these problems and allows the orthodontist to focus on the task of treatment rather than hygiene, which is the primary objective.

Figure 1:
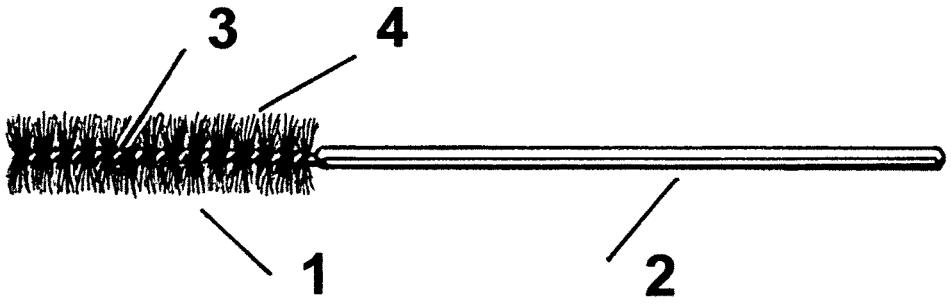
FIG. 1 is a lateral view of the orthodontic toothbrush
Figure 2:
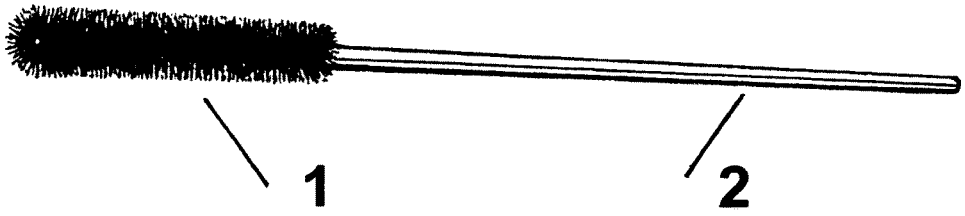
FIG. 2 is a perspective view of the orthodontic toothbrush

The following numbered list corresponds to the parts as detailed in the views

1. cylindrical configuration of bristles on brush head

2. handle of orthodontic toothbrush attached to cylindrical head in perspective view

DETAILED DESCRIPTION

The invention is designed for the purpose of brushing teeth while orthodontic appliances are present on the teeth. With the unique shape of this toothbrush patients can effectively, easily, thoroughly and simultaneously brush under the wings of the brackets, adjacent to and between the teeth and brackets and also the area between the brackets and the gum line. These are the areas most associated with decalcification of the teeth due to inadequate brushing during orthodontic treatment.

The brush 1 is made with a braided wire core 3 thru which nylon bristles 4 used in toothbrushes are wound and configured in a radial 360 degree pattern. The brush is long enough to affect a cylindrical shape. The length of the cylinder and the diameter of the circular pattern of bristles can vary to accommodate different patients. There may be 2 or 3 standard sizes. The inner core may also be manufactured from a cylindrical piece of plastic.

The brush is used in a horizontal stroke above and below the brackets but because of its shape requires no special manipulation to clean thoroughly around, under, between and above or below the orthodontic brackets.

The bristles of the brush are set in a cylindrical pattern around a central wire or a plastic core. They radiate out 360 degrees from the center.

The central core either wire or plastic is attached to a plastic handle 2. The handle can be equipped with a built in timer. The brush can also be manufactured so that it can be either battery or electrically operated.

The cylindrical brush can be made in various lengths from 5 to 50 millimeters.

The brushes radial pattern of bristles can vary from 5 to 20 millimeters. All toothbrushes have their bristles attached to a large plastic rectangular base. Because these brushes end up being large and bulky it is very difficult to place the toothbrush properly and at an angle necessary to clean above and below the brackets and down to the gum line. Many patients find accurately placing a toothbrush mentally and physically challenging due to the size of all toothbrushes and most do not have the manual dexterity necessary for proper placement.

Because of the radial pattern of the ortho-buddy bristles, the cylindrical shape of the brush and the overall diameter of the bristles as pictured in FIG. 1 it is easy for patients to place the brush in the proper place and brush their teeth effectively and easily. No special manipulation is required for brushing above and below the brackets and usage is self evident therefore easily understood and quickly accomplished.

The inner core, either wire or plastic will be slightly flexible. The handle can be equipped with a timer. The brush can also be modified to a battery operated or electrically operated version. This version would have a rotary movement or a combined rotary linear movement.

I claim as the inventor:

1. A method for cleaning around, under, between, and above and below, orthodontic brackets of a patient's teeth, comprising:

a) providing a manual orthodontic toothbrush having a handle; and only one brush extending axially from the handle, wherein said brush includes a central core having bristles that extend in a 360 degree radial pattern therefrom, wherein said bristles extend in a radial diameter from 5 to 20 millimeters wherein said central core is formed of braided wire or a plastic tube, wherein said brush has a cylindrical shape and a length in a range of 5 to 50 millimeters; and, b) brushing the teeth utilizing the orthodontic toothbrush in a horizontal stroke to simultaneously clean between teeth and brackets on adjacent teeth.

2. The method of claim 1 wherein brush has a length in a range of 5 to 25 millimeters.

* * * * *